US005273190A

United States Patent [19]

Lund

[11] Patent Number: 5,273,190

[45] Date of Patent: Dec. 28, 1993

[54] QUICK SHOT SINGLE BARREL DISPENSING SYSTEM

[76] Inventor: William J. Lund, 4271 Riviera Dr., Stockton, Calif. 95204

[21] Appl. No.: 919,940

[22] Filed: Jul. 27, 1992

[51] Int. Cl.[5] ..... B67D 5/00

[52] U.S. Cl. ..... 222/83; 222/82; 222/105; 222/137; 222/145; 222/326; 222/386

[58] Field of Search ..... 222/1, 80, 81, 82, 83, 222/85, 87, 105, 136, 137, 145, 326, 386

[56] References Cited

U.S. PATENT DOCUMENTS

| | | | |
|---|---|---|---|
| 3,164,303 | 1/1965 | Trautmann | 222/136 X |
| 3,195,778 | 7/1965 | Coates | 222/80 |
| 3,766,917 | 10/1973 | Wimmer | 222/80 X |
| 3,794,221 | 2/1974 | Hostettler et al. | 222/80 X |
| 3,836,695 | 9/1974 | Strecker et al. | 174/23 |
| 4,511,415 | 4/1985 | Dienes | 156/48 |
| 4,576,661 | 3/1986 | Persson | 156/48 |
| 4,629,522 | 12/1986 | Klebl et al. | 156/48 |
| 4,735,509 | 5/1988 | Rausch | 222/145 X |
| 4,755,241 | 7/1988 | Steinberg | 156/48 |
| 4,783,227 | 11/1988 | Meador | 156/48 |
| 4,784,707 | 11/1988 | Wefer et al. | 156/48 |
| 4,830,793 | 5/1989 | Fermigier et al. | 264/39 |
| 4,913,197 | 4/1990 | Friedrich | 141/3 |
| 4,938,167 | 7/1990 | Mizuho et al. | 118/713 |
| 4,941,932 | 7/1990 | John | 156/98 |
| 4,964,361 | 10/1990 | Aebersold | 118/302 |
| 4,966,468 | 10/1990 | Bruning | 222/386 X |
| 4,996,940 | 5/1991 | Cleary | 118/306 |
| 5,022,838 | 6/1991 | Payne | 425/145 |
| 5,027,975 | 6/1991 | Keske et al. | 222/1 |

*Primary Examiner*—Andres Kashnikow
*Assistant Examiner*—J. A. Kaufman
*Attorney, Agent, or Firm*—Walter A. Hackler

[57] ABSTRACT

A syringe-dispensing system includes a housing containing at least one sealed bag of a fluid reactive compound and a nozzle in fluid communication with the housing for providing an outlet from the housing for the compound. A shaft disposed within the housing and attached to a handle for moving the shaft longitudinally within the housing is provided, along with apparatus for piercing the bag upon movement of the shaft in one direction. A piston enables forcing of the compound out of the housing through the nozzle upon movement of the shaft in an opposite direction.

2 Claims, 3 Drawing Sheets

QUICK SHOT SINGLE BARREL DISPENSING SYSTEM

The present invention generally relates to an apparatus for mixing and dispensing of fluid compounds and is particularly useful for mixing of organic resins and polyisocyanates to dispense polyurethane foam, as well as other epoxy-type resins.

Epoxies are monomers, or pre-polymers, that further react with curing agents to yield high performance thermo-setting plastics. These compounds, along with synthetic foams, such as polyurethane foams, require uniform mixing in order to provide a homogeneous product.

The particular problem in the case of polyurethane foam is that the organic resin and polyisocyanates react relatively rapidly, thus inhibiting uniform mixing of the compounds. Guns, and/or syringes, for dispensing epoxies and polyurethane foams have many uses such as, for example, the sealing of conduits to protect wires from environmental erosion such as taught by U.S. patent application Ser. No. 07/787,152, filed Nov. 4, 1991, now Pat. No. 5,210,191 "Spray Nozzle for Sealing Conduit," and many other applications too numerous to mention.

Heretofore, complex apparatus has been developed such as that forth in U.S. Pat. No. 5,027,975 for mixing and dispensing reactable fluid materials. However, because of the reactive nature of the materials, passages within the gun may be blocked which disenables the gun and requires extensive cleaning thereof.

The present invention is directed to a syringe dispensing system, which may be disposable because of its simple construction. At the same time, because of the simple construction and few parts comprising the syringe dispensing system, rapid and efficient cleaning thereof is also facilitated.

SUMMARY OF THE INVENTION

A syringe dispensing system, in accordance with the present invention, generally includes housing means for containing at least one sealed bag of the compound to be dispensed. Preferably, the housing means is sized for containing at least two bags of reactable fluid compounds. Means are provided, in fluid communication with the housing means, for providing an outlet from the housing means for the compounds.

A shaft is provided within the housing means, attached to handle means for moving the shaft longitudinally within the housing means. Fixed to the shaft are bag rupturing means for piercing the bag, or bags, upon movement of the shaft in one direction; and piston means are provided for forcing the compound, or mixed compound, out of the housing means through the nozzle means upon movement of the shaft in an opposite direction.

More particularly, the syringe dispensing system includes a means for releasably attaching the piston means to the shaft and rupturable membrane means is provided and disposed between the bag rupturing means and the nozzle means for preventing premature dispensing of the compound through the nozzle means.

Optionally, means may be provided for engaging the bag rupturing means with the piston means for movement together with the shaft in the opposite direction.

Importantly, the present invention further includes means for mixing the fluid reactable compounds after rupture thereof by the bag rupturing means. The mixing means is attached to the shaft and includes a plurality of apertures in a plate, with the latter providing means for supporting both the bag rupturing means and the mixing means.

More particularly, the bag rupturing means may include a plurality of projections on the plate.

The method in accordance with the present invention for mixing and dispensing of compounds includes the steps of placing sealed bags of compounds into a chamber having a volume at least thirty percent (30%) greater than the volume of the bags, sealing the chamber, and thereafter rupturing the bags. After bag rupture, the compounds are mixed by passing the compounds through apertures to commingle the compounds; and the commingled compounds are ejected out of the chamber.

Alternatively, the mixing of the compounds may be accomplished by shaking of the chamber following bag rupture.

BRIEF DESCRIPTION OF THE DRAWINGS

The advantages and features of the present invention will be better understood by the following description when considered in conjunction with the accompanying drawings in which.

DETAILED DESCRIPTION

Figure 1:
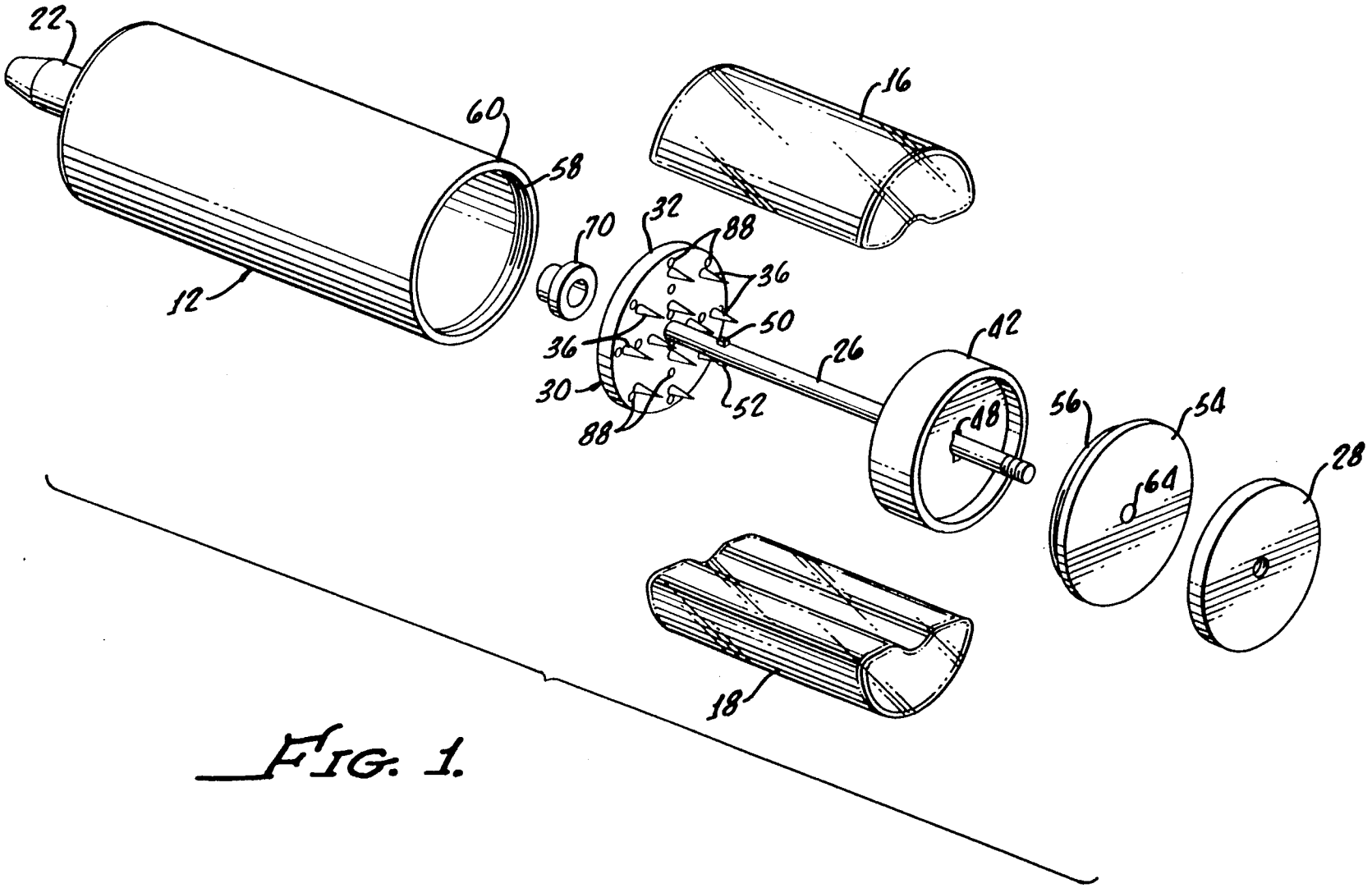
FIG. 1 is an exploded perspective view of the dispensing system in accordance with the present invention, generally showing a housing, a nozzle, a shaft, a handle, a bag-rupturing means, a piston, and a plurality of bags containing fluid reactive compounds.

Turning now to FIG. 1, there is generally shown a syringe-dispensing system 10 in accordance with the present invention, generally including a housing 12 which provides a means for retaining sealed bags 16, 18 of fluid reactive compounds, such as an epoxy and a curing agent, or an organic resin and a polyisocyanate. The housing may be cylindrical in shape and be formed of any suitable plastic or metal. The bags 16, 18 may be formed of any suitable rupturable material, such as polyethylene or the like which is non-reactive with the compounds stored therein.

The sealed bags 16, 18 provide an advantage for the storage of chemicals over a period of time. For example, certain chemicals may, with exposure to air, decompose or crystallize and thereby render portions of the chemicals unusable. By sealing the chemicals in bags, air can be left in the housing without crystallization of the chemicals.

Importantly, as hereinafter discussed, by leaving significant amounts of air, for example, up to thirty percent by volume, in the housing, mixing of the chemicals after rupturing the bags 16, 18 is significantly improved.

Figure 2:
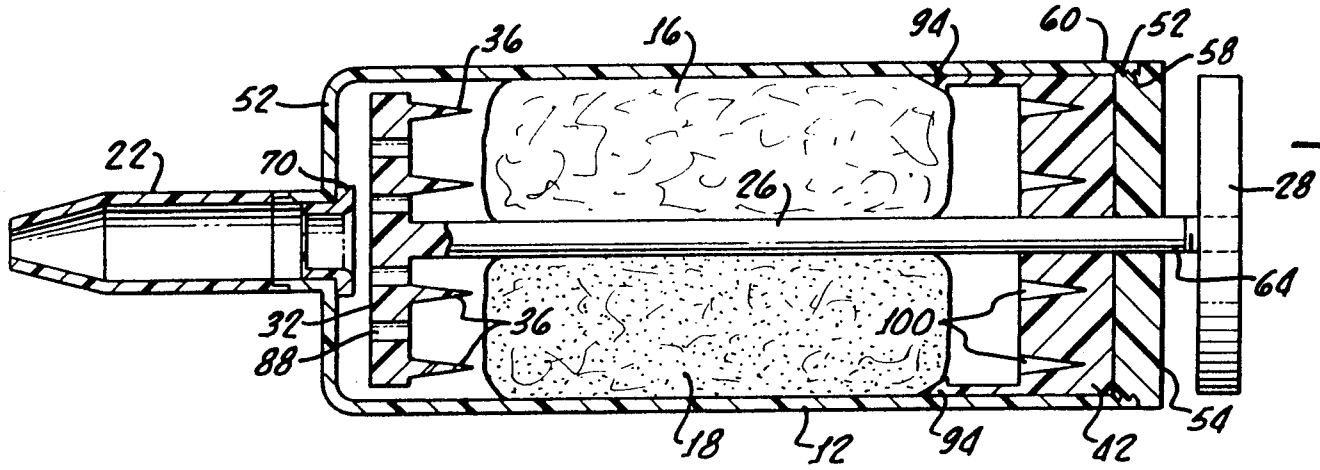
FIG. 2 is a cross-sectional view of the dispensing system, as shown in FIG. 1, showing unruptured bags of fluid reactive compounds.
Figure 3:
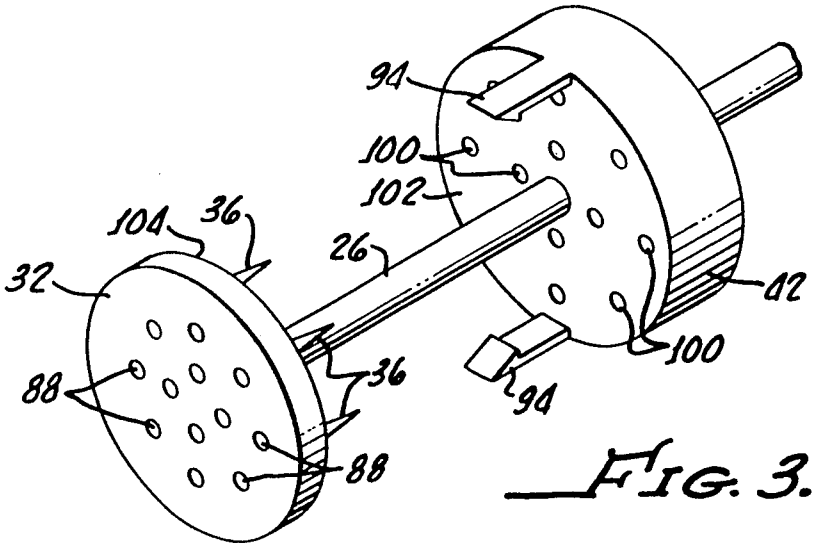
FIG. 3 is a perspective view of the bag-rupturing means, piston and shaft.

Turning again to FIG. 1, as well as to FIG. 2, a nozzle 22 in fluid communication with the housing 12 provides an outlet from the housing 12 for the compounds. A shaft 26 is provided within the housing 12 and attached to a handle 28 which provides means for moving the shaft longitudinally within the housing 12, as hereinafter described in greater detail.

A plate 30, attached to the shaft, and having a circumference sized for fitting within the housing 12 includes a plurality of projections 36 which provide means for piercing the bags 16, 18 upon movement of the shaft 26 in one direction, shown by an arrow 40.

In addition, a piston 42 provides means for forcing the compounds out of the housing 12 through the nozzle 22 upon movement of the shaft 26 in an opposite direction indicated by an arrow 44. A slot 48 in the piston 42 and ears 50 disposed on the shaft 26 provide a means for releasably attaching the piston 42 to the shaft 26 as will be hereinafter discussed in greater detail.

The housing 12 may include an integral front portion 52 and a removable back 54 having threads 56 or the like thereon for enabling removable engagement with threads 58 on a rear portion 60 of the housing 12. This configuration enables easy removal of the shaft 26, plate 32, piston 42 from the housing 12 for cleaning or for the reloading of bags 16, 18. A hole 64 in the back 54 is sized for passage of the shaft 26 therethrough and for enabling the handle 28 to move the shaft in the direction of the arrows 40, 44, as hereinafter described in connection with the description of mixing of the chemicals in the bags 16, 18.

In order to prevent premature dispensing, or leaking, of the compound, or mixed compounds, through the nozzle 22, a seal, or rupturable membrane 70, is provided for temporarily covering a passage 72 between the housing 12 and the nozzle 22.

When repeated use of the syringe dispensing system 10 is anticipated, this seal 70 is replaced in the passage 72 before insertion of the bags 16, 18.

Threads 78 on the nozzle 22 and threads 80 on a projecting portion 82 of the housing front 52 enable convenient replacement of the nozzle for both accommodating different sized nozzle tips and openings, and for facilitating cleaning of the nozzle 22 if the system end is not utilized as a disposable system.

Figure 5:
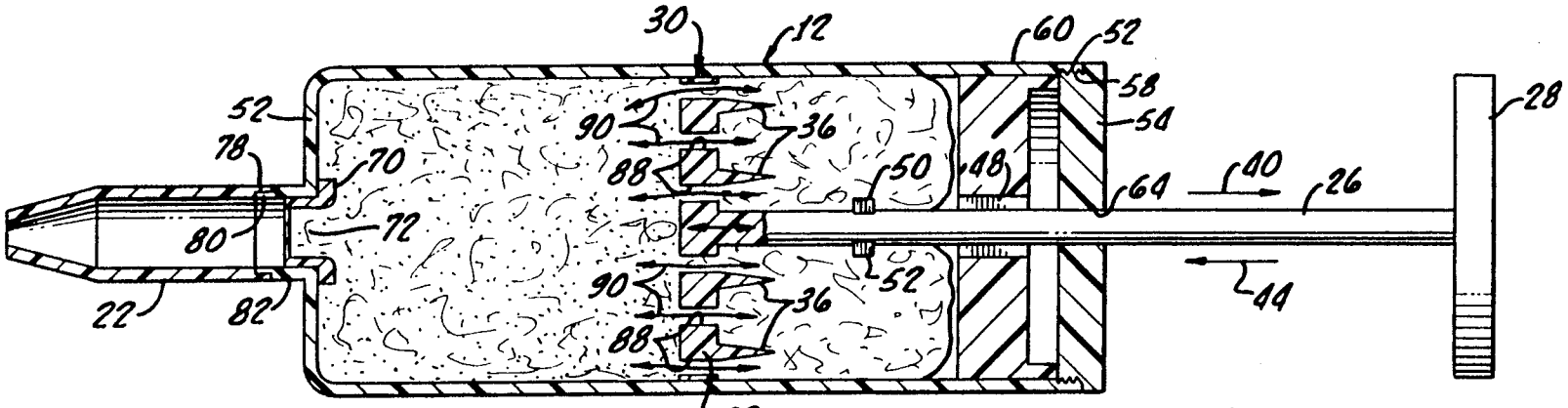
FIG. 5 is a cross-sectional view of the dispensing system showing the mixing step following bag rupture.
Figure 6:
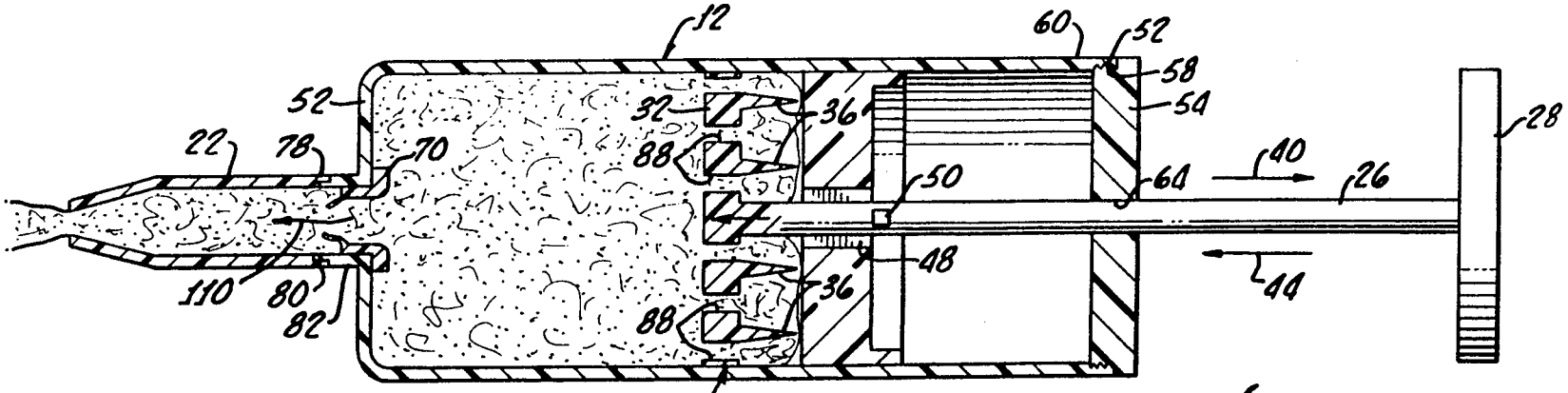
FIG. 6 is a cross-sectional view similar to FIG. 5 showing the ejection of the mixed fluid reactive compound through the nozzle.

In operation, as shown in FIGS. 5 and 6, the rupturable bags 16, 18 are broken by the projections 36 upon movement of the shaft 26 and handle 28 in the direction of the arrow 40. A plurality of apertures in the plate 22 enables the compounds in the bags 16, 18 to flow therethrough as indicated by the arrows 90 in FIG. 5. Repeated movement of the handle in opposing directions as indicated by the arrows 40, 44 enables the compounds to pass through the apertures for the purpose of thoroughly mixing the chemicals.

It has been found that complete and thorough mixing is enhanced when the combined volume of the bags 16, 18 is about 70% of the volume of the housing 12. That is, there should be about 30% by volume air space provided for proper mixing.

Figure 4:
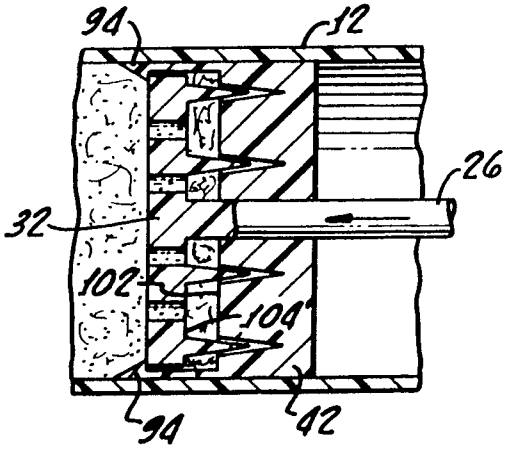
FIG. 4 is a partial cross-sectional view of the system shown in FIG. 1, showing the bag-rupturing means being coupled to the piston.

To facilitate the dispensing of the mixed compounds from the housing 12, latches 94 may be attached to the piston 42 to provide a means for attaching, or engaging, the plate 32 with the piston 42 for movement together with the shaft 26 in the direction of the arrow 44 in order to dispense mixed compounds through the nozzle 22. FIG. 4 shows the engagement of the latches 94, 96 with the plate 32 as the plate 32 is drawn into direct contact with the piston 42.

After mixing and engagement of the piston 42 to engage one another, the mixed compound may be ejected through the nozzle by movement of the handle 28 and shaft 26 in the direction of arrow 44 to rupture the seal 70 and eject mixed compound through the nozzle as indicated by arrow 110. Piston 42 has a plurality of depressions 100 for receiving projections 36 in order to enable the bag rupturing means and piston to nest together.

As an alternative to the mixing of the compounds in the bags 16, 18 through the apertures 88, if the fluid reactive compounds within the bags 16, 18 are of low enough viscosity, following bag 16, 18, rupture, the housing may be shaken vigorously in order to mix the compounds before dispensing through the nozzle as shown in FIG. 6.

In addition, while a rupturable seal 70 is shown, any suitable stop or plug which may be disposed in the nozzle 22 and forced thereout by pressure exerted on the mixed compound via the shaft 26 and handle 28.

It should be appreciated that the projections 36 and apertures 38 may be sized differently depending upon the viscosities of the reactive compounds utilized and in fact, in some instances, the projections 36 may not be necessary if the bag 16, 18 rupture strength is sufficiently low to enable bursting thereof without penetration.

It should also be apparent that the piston 42 is releasably attached to the shaft by the ears 50, 52 and slot 48 by mere rotation of the handle 28 and shaft 26. Alternatively, any other clip or releasably engaged device may be utilized for this purpose.

Although there has been hereinabove described a specific syringe dispensing system in accordance with the present invention, for the purpose of illustrating the manner in which the invention may be used to advantage, it should be appreciated that the invention is not limited thereto. Accordingly, any and all modifications, variations, or equivalent arrangements which may occur to those skilled in the art, should be considered to be within the scope of the present invention as defined in the appended claims.

What is claimed is:

1. A syringe dispensing system comprising:

housing means for containing at least two sealed bags of a compound to be dispensed;

nozzle means, in fluid communication with said housing means, for providing an outlet from the housing means for the compound;

a shaft disposed within said housing means;

handle means, attached to said shaft, for moving the shaft longitudinally within the housing means;

bag rupturing means, attached to said shaft, for piercing said bag upon movement of said shaft in one direction, said bag rupturing means comprising a plurality of pointed projections on a plate, said pointed projections extending in a direction, from the plate, opposite the nozzle means;

mixing means, attached to said shaft, comprising a plurality of apertures in said plate, for mixing the compounds in the at least two bags after rupture thereof by the bag rupturing means;

rupturable membrane means, disposed between said bag rupturing means and said nozzle means, for preventing premature dispensing of the compound through the nozzle means;

piston means for forcing said compound out of said housing means, through said nozzle means, upon movement of said shaft in an opposite direction, said piston means comprising a circular disk having means, defining a plurality of depressions thereon, for receiving the pointed projections, in order to enable the bag rupturing means and piston means to nest together when the bag rupturing means and piston means are engaged with one another; and latch means for engaging said bag rupturing means with said piston means, in a nested arrangement, for movement together with said shaft in the opposite direction.

2. The syringe dispensing system according to claim 1 wherein said housing means is sized to enable at least two bags to occupy approximately 70% by volume of an interior of said housing means.

* * * * *